US007659792B2

(12) United States Patent
Kocharyan et al.

(10) Patent No.: US 7,659,792 B2
(45) Date of Patent: Feb. 9, 2010

(54) CIRCULATOR DEVICE AND A METHOD FOR ASSEMBLY

(75) Inventors: Karen N. Kocharyan, Burlington, MA (US); Bradley J. Wright, Fayetteville, NY (US)

(73) Assignee: Anaren, Inc., East Syracuse, NY (US)

( * ) Notice: Subject to any disclaimer, the term of this patent is extended or adjusted under 35 U.S.C. 154(b) by 73 days.

(21) Appl. No.: 12/055,717

(22) Filed: Mar. 26, 2008

(65) Prior Publication Data

US 2009/0243746 A1 Oct. 1, 2009

(51) Int. Cl.
*H01P 1/36* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

2004/0174224 A1* 9/2004 Kingston et al. ..... 333/1.1

* cited by examiner

*Primary Examiner*—Stephen E Jones
(74) *Attorney, Agent, or Firm*—Daniel P. Malley; Bond, Schoeneck & King, PLLC

(57) ABSTRACT

The present invention is directed to a circulator/isolator device that includes a housing having a substantially planar base portion integrally connected to a segmented flexible wall structure extending in a direction normal thereto. The substantially planar base portion and the segmented flexible wall structure forms an interior housing volume having a predetermined geometry. The segmented flexible wall structure includes a plurality of port apertures disposed therein. The plurality of port apertures are separated from each other and disposed at predetermined locations in the segmented flexible wall structure. A central stack is disposed within the interior housing volume at a predetermined position on the base portion. The central stack includes a substantially flat conductor having a plurality of port structures extending therefrom. Each of the plurality of port structures are disposed at predetermined positions at a perimeter portion of the substantially flat conductor. The predetermined positions substantially conform to the predetermined locations such that each of the plurality of port structures extend through the segmented flexible wall structure at a corresponding one of the plurality of port apertures. A cover member is disposed within the housing at one end thereof, opposite the base portion, such that an exterior major surface of the cover is accessible via an exterior of the device and an interior major surface of the cover is disposed adjacent the central stack. A retaining member is disposed around a perimeter of the segmented flexible wall structure at the one end. The retaining member is configured to apply a substantially uniform radial compressive force to the segmented flexible wall structure to retain the cover member there within. The cover member applies a registration force to the central stack assembly to maintain the central stack assembly at the predetermined position.

33 Claims, 3 Drawing Sheets

CIRCULATOR DEVICE AND A METHOD FOR ASSEMBLY

BACKGROUND OF THE INVENTION

1. Field of the Invention

The present invention relates generally to RF transmission line components, and particularly to microwave ferrite circulator/isolator devices.

2. Technical Background

A ferrite circulator/isolator is a passive multi-port microwave device that is typically employed in RF transmission line applications such as radar, cell phone applications, etc. The ferrite circulator/isolator device is typically used to provide a low loss transmission path for RF energy in one direction and substantially prevent any transmission of energy in the reverse direction. In a typical communications device, an RF signal may be modulated, amplified and directed to an antenna for transmission over a communication channel. If a reflected RF signal or some other RF signal is permitted to propagate in the reverse direction, an unprotected signal source may be significantly damaged. The ferrite circulator/isolator device is configured to attenuate such RF transmissions to thereby prevent such damage from occurring.

A typical ferrite circulator includes three ports, and is generally referred to as a Y-junction circulator. In operation, when an RF signal is directed into a first port, the RF signal will be accessible via the second port in sequence, i.e., the port immediately adjacent the input port. The RF signal will be substantially attenuated and will not be available at the third port in the sequence, that is, the port immediately adjacent to the second port on the other side of the first input port. On the other hand, if an RF signal is directed into the second port, it will be available as an RF output signal at the third port, but will not be available at the first port. Finally, if an RF signal is introduced at the third port, it will be available as an RF output at the first port, but not at the second port. A circulator, therefore, propagates RF power from one adjacent port to the next in a sequential, circular fashion. The RF signal circulation may be right-handed (RH) or left-handed (LH).

The circulation action in circulators/isolators is achieved by utilizing the "gyromagnetic effect" that is characteristic of ferrite materials. The atoms of these materials are known to have an intrinsic angular momentum ("spin") and a permanent magnetic moment. When the atoms are exposed to an external biasing magnetic field, a torque normal to the intrinsic angular momentum is applied. The torque causes the magnetic moment of the atoms to "precess" around the magnetic field. Precession refers to a movement of the magnetic moment around the magnetic field lines. From an intuitive standpoint, one may visualize each atom as a spinning top that wobbles on a flat surface, with its individual axis of rotation (e.g., magnetic moment) moving around a fixed vertical axis in a circular motion. When the precession frequency is close to the frequency of the RF signal, an applied magnetic field may be employed to control the propagation of RF signal. In other words, RF signal circulation may be implemented by applying a predetermined DC magnetic field to an appropriately designed ferrite material.

When an RF signal is directed into the input port of the circulator, circulating phase shifted versions of the RF signal are induced within the ferrite discs. The degree of phase shift between counter circulating fields is a function of the strength of the DC magnetic field and diameter of the ferrite material. The circulator operates in accordance with the principles of superposition and constructive/destructive interference of counter-rotating RF waves. Using the example from above, when an RF signal is directed into the first port, the counter circulating RF signals are substantially in phase with each other at the second port, and therefore, they constructively interfere and reinforce each other. The amount of signal available at the second port is measured by what is commonly referred to as the insertion loss. In a properly functioning device the insertion loss is typically in the range of a few tenths of a decibel (dB). At the third port, the RF signals are out of phase with each other and substantially cancel each other. The term "substantially" refers to the fact that, in practice, the cancellation is not perfect and a residual signal may be detected. The amount of residual signal available at the third port, appropriately referred to as the "isolation," is measured by the ratio of the residual signal and the incident signal. The isolation is typically between −25 dB and −30 dB.

A circulator may be configured as an isolator by terminating one of the ports with a "matched load." In implementing a matched load, RF engineers ensure that, from an impedance standpoint, the complex impedance of the load is the complex conjugate of the output port impedance. As noted above, an isolator permits RF signal propagation between the two remaining ports in one direction only. RF power flow in the opposite direction is substantially inhibited. Now that the general operating principles have been briefly touched upon, a similarly brief description of the structure of a junction circulator is provided.

A junction circulator includes both electrical and magnetic circuit components and may be implemented using either a stripline or microstrip transmission configuration. The first sub-assembly discussed herein is referred to as the central stack assembly. The electrical portion of the central stack includes a flat center conductor that has three branches extending symmetrically outward from the central conductive portion. The three branches function as the ports of the circulator and are positioned 120° apart from each other. The center conductor is sandwiched between a pair of ferrite discs. The outer surface of both the top ferrite disc and bottom ferrite disc are in contact with ground planes to thereby form a stripline configuration. A permanent magnet is disposed over each ground plane. The permanent magnets apply a predetermined magnetic field to bias the ferrite discs in a predictable manner. A steel pole member may be inserted between each ground plane/magnet pair. The function of the steel pole member is to ensure that the biasing magnetic field applied to the ferrites is substantially uniform. The magnetic properties of both the ferrite material and the magnet may result in temperature variations. Therefore, the central stack may also include thermal compensators that are configured to ensure that the thermal stability of the circulator is maintained. The thermal compensators, which may be fabricated using nickel alloys, offset the aforementioned temperature variations.

In one approach that has been considered, after the central stack is assembled, it is disposed in a housing and secured in place with an interlocking cover plate. The housing and the interlocking cover must apply a certain amount of compression force to the stack to properly secure it within the housing. In a three-port device, the housing may be fabricated having three openings formed in the side walls thereof The openings are configured to accommodate the three ports that extend outwardly from the central conductor. Each port passes through a corresponding one of the three openings and is, therefore, accessible from the exterior of the housing after the assembly of the circulator is completed. Because the housing and the cover compose a part of the magnetic return path, they are typically fabricated using a ferrous metal (e.g., steel) and should have sufficient contact area to transfer the magnetic flux generated by the magnet. From a mechanical perspective, the housing and cover plate must have sufficient mechanical strength to protect the circulator structure from the various mechanical and vibrational forces that may be applied to the structure during its operational life.

The locking arrangement may be realized by forming threads in the inner surface of the housing walls. A second set of threads may be formed around the circumference of the cover plate. The second set of threads formed in the cover plate is, of course, configured to engage the first set of threads formed in the walls of the housing. Once the threads are engaged, a rotational force is applied to the cover plate. The threaded arrangement forces the cover plate downwardly within the housing to thereby apply a compressive force to the stack disposed therein.

Unfortunately, this approach has various drawbacks associated with it. Namely, the manufacturing of the housing and cover is a laborious and expensive process. The process requires several production steps that are performed using turning and milling machines. These production steps are relatively expensive and, therefore, undesirable in a large scale production.

In a second approach, a microwave surface mount circulator having a modified housing arrangement is considered. The circulator under consideration includes a housing fabricated from a single piece of a sheet metal. Six portions are removed from the perimeter of the sheet metal piece to produce a flat piece of sheet metal having six arm structures extending from a central portion thereof The central portion of the sheet metal functions as the bottom of the housing. Subsequently, slanted slots are formed in each of the six arm structures. The six arm structures are then folded up from the bottom portion to form a six-sided polygonal structure. The six side portions are substantially perpendicularly with respect to the bottom portion of the housing and form six flat side walls having slanted slots open at one end thereof.

The second approach includes both a locking cover and a pressing cover. The pressing cover is formed from a piece of ferrous material and has a polygonal shape that matches the geometry of the housing interior. As such, it is configured to fit snugly within the six housing walls under the slanted slots. The locking cover has a circular shape and includes six locking tabs disposed around the perimeter of the plate and extends outwardly therefrom. The locking tabs are configured to mate with the slanted slots disposed in the walls of the housing.

Once the housing and the covers are available, the central stack is disposed within the housing. The pressing cover is disposed within the housing over the central stack. The six locking tabs are inserted into the slanted slots. The locking plate is rotated around the vertical axis of the circulator. The slanted slots force the locking plate to move in a downward direction to apply a compression force to the pressing plate and the central stack. The assembly is essentially complete once the six tabs are interlocked with the slanting slots.

While the second approach under consideration may be deemed an improvement over the first approach considered herein, the locking arrangement described in the second approach has several drawbacks. The polygonal pressing cover, for example, is a necessary component in the second approach under consideration. It is required to prevent any shifting and misalignment of the stack members caused by the rotation of the locking cover. Unfortunately, the pressing cover represents otherwise unusable space between the central stack and the cover. The same applies to the space between the top of locking plate and the top of the side walls, which is necessary to mechanically strengthen the interlocking slots if sufficient stack compression is to be provided. The unusable space directly translates to a circulator component having a relatively larger over-all height dimension, which is, of course, undesirable.

Another drawback in the second approach under consideration relates to the existence of the air gaps between the housing and the covers. The presence of the slanted slots at the side walls is also undesirable. Both of these design features substantially reduce the cross sectional area of the magnetic return path formed by the housing and cover. Because the available magnetic flux in magnetic loop is proportional to the cross sectional area of the magnetic return path, any reduction of the cross sectional area of the magnetic return path directly translates to a reduction of the available magnetic field strength.

Accordingly, it would be desirable to eliminate the locking arrangement and provide an efficient means for enclosing the central stack within the circulator/isolator without requiring any rotational action. What is also needed is a circulator that eliminates the need for a pressing cover. What is also needed is a circulator that substantially reduces the loss of DC magnetic flux by increasing the cross sectional area of the magnetic return path.

SUMMARY OF THE INVENTION

The present invention addresses the needs described above by eliminating the locking arrangement and providing an efficient means for enclosing the central stack within the circulator/isolator without requiring any rotational action. The present invention includes a circulator that does not include a pressing cover. The circulator of the present invention substantially reduces the loss of DC magnetic flux by increasing the cross sectional area of the magnetic return path. The cross sectional area of the magnetic return path is increased by eliminating air gaps, the slotted locking arrangement, and by providing ferrous material in the region where the cover plate meets the side walls of the housing.

One aspect of the present invention is directed to a circulator/isolator device that includes a housing having a substantially planar base portion integrally connected to a segmented flexible wall structure extending in a direction normal thereto. The substantially planar base portion and the segmented flexible wall structure forms an interior housing volume having a predetermined geometry. The segmented flexible wall structure includes a plurality of port apertures disposed therein. The plurality of port apertures are separated from each other and disposed at predetermined locations in the segmented flexible wall structure. A central stack is disposed within the interior housing volume at a predetermined position on the base portion. The central stack includes a substantially flat conductor having a plurality of port structures extending therefrom. Each of the plurality of port structures are disposed at predetermined positions at a perimeter portion of the substantially flat conductor. The predetermined positions substantially conform to the predetermined locations such that each of the plurality of port structures extend through the segmented flexible wall structure at a corresponding one of the plurality of port apertures. A cover member is disposed within the housing at one end thereof, opposite the base portion, such that an exterior major surface of the cover is accessible via an exterior of the device and an interior major surface of the cover is disposed adjacent the central stack. A retaining member is disposed around a perimeter of the segmented flexible wall structure at the one end. The retaining member is configured to apply a substantially uniform radial compressive force to the segmented flexible wall structure to retain the cover member there within. The cover member applies a registration force to the central stack assembly to maintain the central stack assembly at the predetermined position.

In another aspect, the present invention is directed to a method for making a circulator/isolator device. The method includes the step of forming a housing from a ferrous material. The housing includes a segmented flexible wall structure configured to form an interior housing volume having a predetermined geometry. The segmented flexible wall structure includes a plurality of port apertures disposed therein. The plurality of port apertures are separated from each other and disposed at predetermined locations in the segmented flexible wall structure. A central stack assembly is provided and includes a substantially flat conductor having a plurality of port structures extending therefrom. Each of the plurality of port structures being disposed at predetermined positions at a perimeter portion of the substantially flat conductor. The predetermined positions substantially conform to the predetermined locations. The central stack further includes a plurality of magnetic circuit components sandwiching the substantially flat conductor therebetween. The central stack assembly is installed within the interior housing volume at a predetermined position. Each of the plurality of port structures extend through the segmented flexible wall structure at a corresponding one of the plurality of port apertures. At least one cover member substantially conforming to the predetermined geometry is provided. The cover member includes an exterior major surface and an interior major surface. The central stack assembly is enclosed within the housing by disposing the at least one cover member over the central stack, and within the interior housing volume at one end thereof such that the exterior major surface is accessible via an exterior of the device and the interior major surface is disposed adjacent the central stack. At least one retaining member is positioned around a perimeter of the segmented flexible wall structure at the one end. The at least one retaining member is configured to apply a substantially uniform radial compressive force to the segmented flexible wall structure to retain the at least one cover member there within. The at least one cover member applies a registration force to the central stack assembly to maintain the central stack assembly at the predetermined position.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
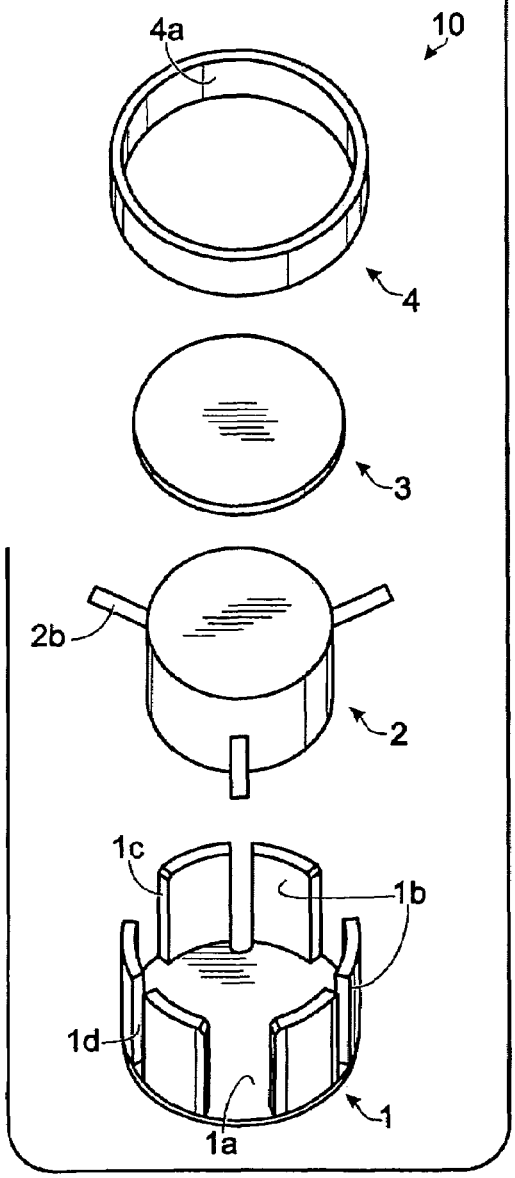
FIG. 1 is an exploded view of a ferrite stripline circulator in accordance with one embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the ferrite circulator of the present invention is shown in FIG. 1, and is designated generally throughout by reference numeral 10.

As embodied herein, and depicted in FIG. 1, an exploded view of a ferrite stripline circulator 10 in accordance with one embodiment of the present invention is disclosed. In this embodiment, the circulator includes a housing 1 configured to accommodate central stack assembly 2. A cover member 3 is configured to be disposed over the central stack assembly 2. A retaining ring 4 is configured to be disposed around housing 1 in the manner depicted herein.

The housing 1 is formed from a sheet of ferrous metal, such as steel, and includes a bottom portion 1*a* and a plurality of side walls 1*b* which are bent to be substantially perpendicular to the bottom portion 1*a*. In one embodiment of the invention, the bottom portion la has a substantially circular geometry. The side walls 1*b*, of course, are configured to conform to the circular geometry of bottom portion 1*a*. Accordingly, the side walls 1*b* form the segments of a common cylinder with a vertical axis of symmetry passing through the origin of the circular bottom portion 1*a*. The side walls 1*b* have three wide openings 1*c* that allow the leads 2*b* of the central junction (stack) 2 to pass through and extend beyond the circulator when the central stack 2 is disposed in the bottom portion 1*a* of the housing 1. The side walls 1*b* have three gaps 1*d* that are formed therein. The gaps 1*d* facilitate the forming of the curved side walls 1*b* and also a degree of flexibility to the side walls 1*b*.

The cover plate 3 is formed from a ferrous metal and is dimensioned to snugly fit into the interior circle formed by the cylindrical side walls 1*b*. During the assembling process, cover plate 3 is placed over the stack 2 and is pressed down with a predefined force to produce the required compression over the central stack 2. At the same time that cover 3 is being compressed, the retaining ring 4 is positioned over the external walls 1*b* of the housing 1 and is forced downwardly. The retaining ring 4 is also made of a ferrous metal, like steel, that provides sufficient mechanical strength and a return path for the magnetic flux to traverse. While the cover is shown as being substantially circular, in other embodiments, other geometries may be employed.

Figure 2:
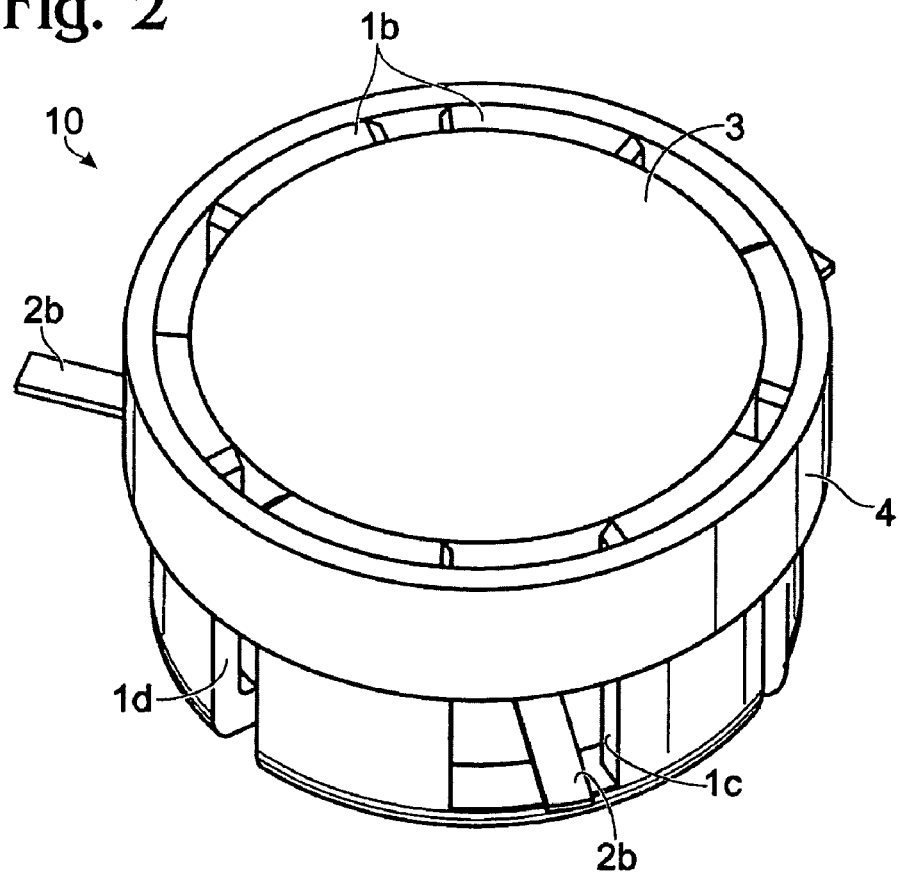
FIG. 2 is a perspective view of a ferrite stripline circulator depicted in FIG. 1.

FIG. 2 is a perspective view of the assembled ferrite stripline circulator 10 depicted in FIG. 1. In this view, the cylindrical nature of side walls 1*b* is clearly depicted. The gaps 1*d* between the separate wall segments 1*b* permit the cylindrical side walls to bend inwardly in response being compressed. Compressing force ensures an intimate gapless contact between the segmented side walls and the cover. The locking arrangement described in the Background section has essentially been eliminated. The arrangement depicted herein, therefore, constitutes substantial improvement of the electrical and magnetic connection between the side walls and the cover vis à vis previously considered approaches. Moreover, because the retaining ring 4 is formed using a ferrous metal, the overall thickness at the point where the cover meets the side walls is greater than the previously considered approaches. This feature of the present invention is noteworthy because it is precisely this portion of circulator housings that the highest loss of magnetic flux usually occurs.

Figure 3:
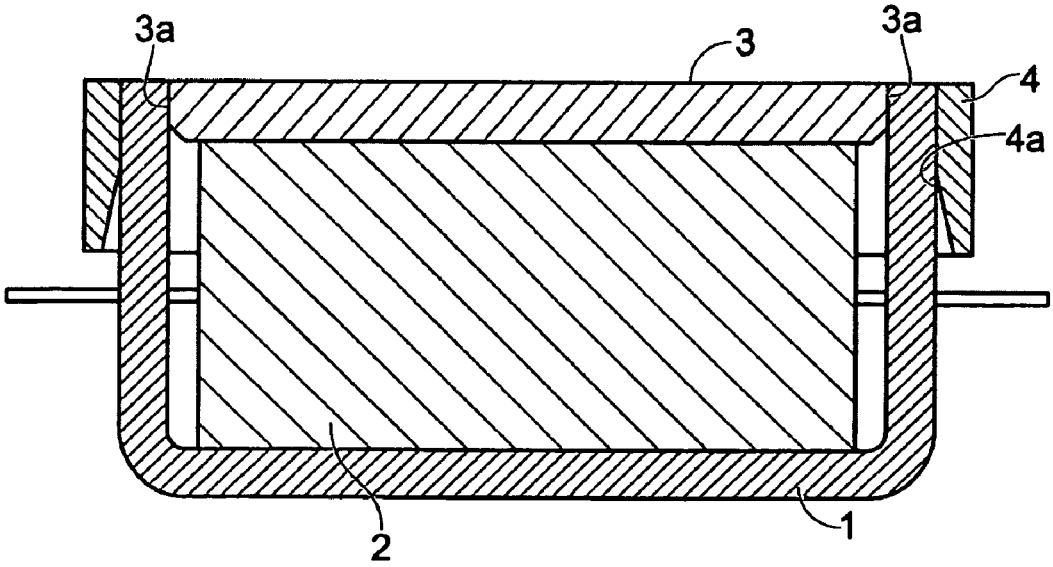
FIG. 3 is a cross-sectional views of the ferrite stripline circulator depicted in FIG. 1.

Referring to FIG. 3, is a cross-sectional views of the ferrite stripline circulator depicted in FIG. 1 is disclosed. Referring to the ring 4 and housing 1 interface, it is clearly seen that the interior surface 4*a* of retaining ring 4 has a taper. The tapered interior surface 4*a*, in effect, forms a conical cross-section with the wide side being substantially coplanar with the top surface of cover plate 3. The tapered interior surface 4*a* simplifies the installation of the retaining ring 4 because the thinner portion of the conical cross-section is the first part of the retaining ring 4 that engages the wall segments 1*b*. Once the relatively thinner portion is in position and the ring 4 is forced downwardly, the side walls 1*b* begin to flex inwardly against the edge 3*a* of the cover plate 3. As the cross-section of the retaining ring 4 becomes progressively thicker, the radial compression force applied to the segments walls 1*b*becomes greater and greater until the retaining ring 4 is fully engaged with the housing 1. As noted previously, the gaps 1*c* and 1*d* provide the cylindrical housing 1 with the flexibility to bend inwardly during this process. The tapered ring 4 is dimensioned to provide sufficient radial compression to secure the cover plate 3 in place, and to preserve the initial downward compression of the stack 2, once the installation of the retaining ring 4 is complete. As noted above, the wide portion of the retaining ring 4 is flush, i.e., coplanar with the top of the housing 1 and the top surface of cover 3, when installation is completed. Therefore, no additional space over the cover is necessary to keep the cover in place.

Figure 4:
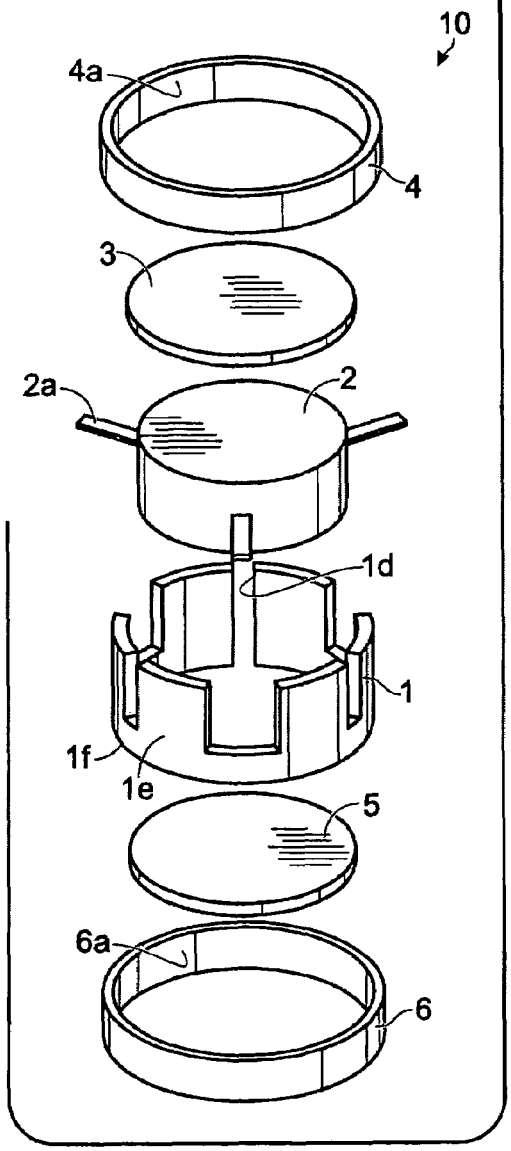
FIG. 4 is a an exploded perspective view of a ferrite stripline circulator in accordance with an alternative embodiment of the present invention.

As embodied herein, and depicted in FIG. 4, an exploded perspective view of a ferrite stripline circulator in accordance with an alternative embodiment of the present invention is disclosed. In this embodiment, the housing of circulator 10 includes a top cover plate 3, a bottom cover plate 5, and a cylindrical sidewall 1.

Figure 5:
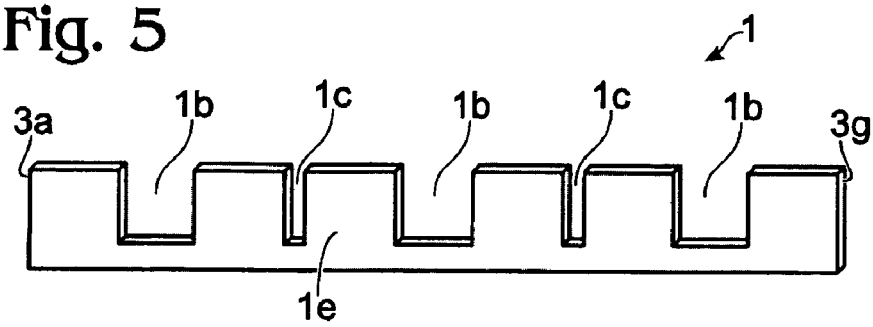
FIG. 5 is a detail view of a sidewall structure depicted in FIG. 4.

Referring briefly to the detail view shown in FIG. 5, the sidewall wall 1 is fabricated from a sheet of metal 1*a* with cutouts 1*b* and 1*c*. The metal sheet 1 is made to conform to the cylindrical geometry shown in FIG. 4 to thereby produce a gap 1*d* where the end portions 3*a* and 3*g* meet. The cutouts 1*b* are configured to accommodate the leads 2*a* of the central stack 2 such that they are accessible from the exterior of device 10 when the device assembly is complete. The narrow openings 1*c* provide flexibility to each of the separate sidewall sections 1*e*.

Referring back to FIG. 4, the bottom cover plate 5 is inserted into cylinder sidewall 1 to be flush relative to the bottom face 1*f* of sidewall 1. The retaining ring 6 is inserted over the cylindrical sidewall I from beneath. The retaining ring 6 has a tapered cross-section 6*a* that permits the installation of the ring 6 over sidewall 1 in the manner previously described in the first embodiments described herein (FIGS. 1-3). Accordingly, the retaining ring 6 provides a radial compression force that secures cover plate 5 within sidewall 1. Like the first embodiment, retaining ring 6 is fully engaged when it is flush relative to the bottom side 1*f* of the sidewall 1. Subsequently, the central stack 2 is positioned over the bottom cover plate 5, within the sidewall 1. The housing is enclosed by disposing the top cover plate 3 over the central stack 2. The top cover plate 3 is locked in place with the top locking ring 4. Like the retaining 6 previously described, the top retaining ring 4 also has a tapered cross-section 4*a*. Because the retaining ring 4 is essentially identical to retaining ring 6, any discussion of the method for installing ring 4 would be duplicative, and is therefore omitted for brevity's sake.

Figure 6:
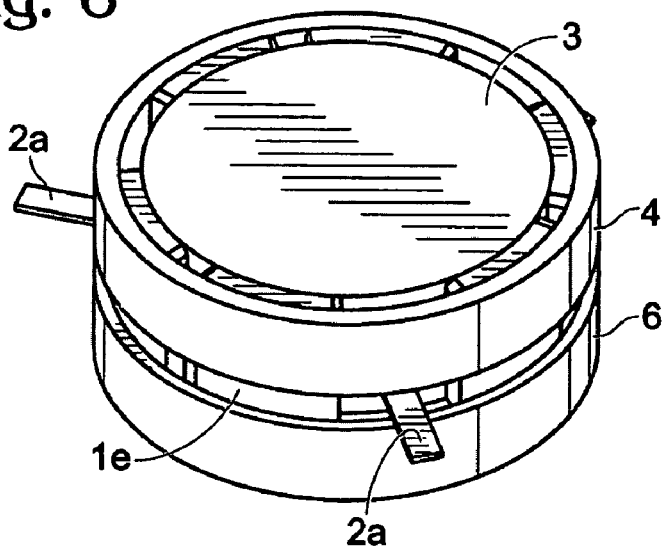
FIG. 6 is a perspective view of a ferrite stripline circulator depicted in FIG. 4.
Figure 7:
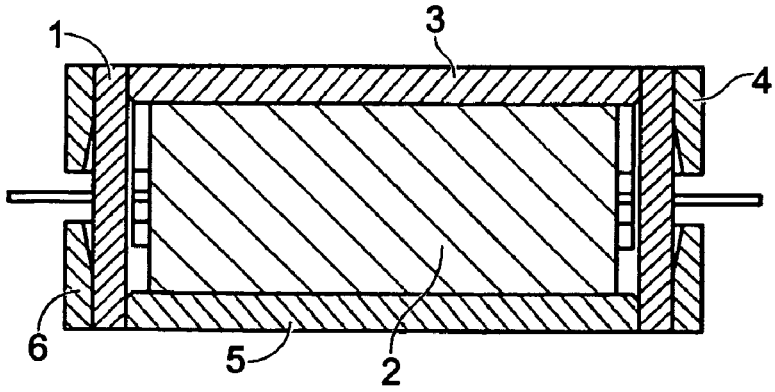
FIG. 7 is a cross-sectional views of the ferrite stripline circulator depicted in FIG. 4.

FIG. 6 is a perspective view and FIG. 7 is a cross-sectional view of the ferrite stripline circulator 10 depicted in FIG. 4. Note that the cover plates 3 and 5, as well as the sidewall 1 are made from a ferrous metal to provide a larger return path for the magnetic flux. These views clearly show that, in the assembled state, the bottom cover plate 5 and retaining ring 6 are flush with the bottom side of the sidewall cylinder 1. Correspondingly, the top cover plate 3 and the retaining ring 4 are flush with the top side of the cylindrical sidewall 1.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A circulator/isolator device comprising:

a housing including a segmented flexible wall structure configured to form an interior housing volume having a predetermined geometry, the segmented flexible wall structure including a plurality of port apertures disposed therein, the plurality of port apertures being separated from each other and disposed at predetermined locations in the segmented flexible wall structure;

a central stack disposed within the interior housing volume at a predetermined position, the central stack including a substantially flat conductor having a plurality of port structures extending therefrom, each of the plurality of port structures being disposed at predetermined positions at a perimeter portion of the substantially flat conductor, the predetermined positions substantially conforming to the predetermined locations such that each of the plurality of port structures extend through the segmented flexible wall structure at a corresponding one of the plurality of port apertures;

at least one cover member substantially conforming to the predetermined geometry and disposed within the housing at one end thereof, the at least one cover member including an exterior major surface accessible via an exterior of the device and an interior major surface disposed adjacent the central stack; and at least one retaining member disposed around a perimeter of the segmented flexible wall structure at the one end, the at least one retaining member being configured to apply a substantially uniform radial compressive force to the segmented flexible wall structure to retain the at least one cover member there within, the at least one cover member applying a registration force to the central stack assembly to maintain the central stack assembly at the predetermined position.

2. The device of claim 1, wherein the housing, the at least one cover and the at least one retaining member are formed from ferrous materials and are configured to form a return path for a magnetic flux.

3. The device of claim 1, wherein the at least one retaining member is a tapered retaining ring having a conical cross-section, the conical cross-section includes a relatively thicker surface that is substantially coplanar relative to the exterior major surface and the one end.

4. The device of claim 1, wherein the predetermined geometry includes a cylindrical shape, the at least one cover and the at least one retaining member being substantially circular.

5. The device of claim 1, wherein the predetermined geometry includes a cylindrical shape, the at least one cover and the at least one retaining member being substantially polygonal.

6. The device of claim 1, wherein the plurality of port apertures include three port apertures and the plurality of port structures include three port structures.

7. The device of claim 1, wherein the segmented flexible wall structure includes a plurality of flexure gaps disposed around the perimeter thereof, the plurality of flexure gaps being configured to translate the substantially uniform radial compressive force applied to the segmented flexible wall structure to the at least one cover member in a substantially uniform manner.

8. The device of claim 1, wherein the segmented flexible wall structure is integrally formed to include a base portion, the base portion enclosing another end of the housing opposite the one end, the base portion also being disposed in a plane substantially perpendicular to the segmented flexible wall structure.

9. The device of claim 8, wherein the at least one cover includes a single cover member disposed within the housing at the one end parallel to the base portion, the single cover member including a single exterior major surface accessible via an exterior of the device at the one end and a single interior major surface disposed adjacent the central stack.

10. The device of claim 9, wherein the at least one retaining member includes a single retaining member substantially conforming to the predetermined geometry and disposed around a perimeter of the segmented flexible wall structure at the one end, the single retaining member being configured to apply the substantially uniform radial compressive force to the segmented flexible wall structure at the one end of the housing.

11. The device of claim 10, wherein the single retaining member is a tapered retaining ring having a conical cross-section, the conical cross-section including a relatively thicker surface that is substantially coplanar relative to the single exterior major surface and the one end.

12. The device of claim 1, wherein the at least one cover includes:

a first cover member disposed within the housing at a first end of the housing, the first cover member including a first exterior major surface accessible via an exterior of the device and a first interior major surface disposed adjacent the central stack, and a second cover member disposed within the housing at a second end of the housing, the second cover member including a second exterior major surface accessible via an exterior of the device and a second interior major surface disposed adjacent the central stack, the first cover member and the second cover member being substantially parallel to each other and substantially normal to the segmented flexible wall structure;

and wherein the at least one retaining member includes:

a first retaining ring disposed around a perimeter of the segmented flexible wall structure at the first end, the first retaining ring being configured to apply the substantially uniform radial compressive force to the segmented flexible wall structure, and a second retaining ring disposed around a perimeter of the segmented flexible wall structure at the second end, the second retaining ring being configured to apply the substantially uniform radial compressive force to the segmented flexible wall structure.

13. The device of claim 12, wherein the first retaining ring is a tapered retaining ring having a conical cross-section, the conical cross-section includes a relatively thicker surface that is substantially coplanar relative to the first exterior major surface and the first end, the second retaining ring is a tapered retaining ring having a conical cross-section, the conical cross-section includes a relatively thicker surface that is substantially coplanar relative to the second exterior major surface and the second end.

14. The device of claim 1, wherein the housing is formed from a substantially circular and integral sheet of ferrous material having an origin and a vertical axis of symmetry disposed at a central portion thereof, the housing including a substantially circular base portion having a radius extending a predetermined radial distance from the origin, a plurality of portions extending from the radius to a perimeter portion of the integral sheet of ferrous material being removed to form the plurality of port apertures and the segmented flexible wall structure, the segmented flexible wall structure being disposed substantially normal to the base portion and substantially parallel to the vertical axis of symmetry.

15. The device of claim 14, wherein a plurality of flexure gaps are formed by removing material from the segmented flexible wall structure.

16. The device of claim 1, wherein the segmented flexible wall structure is formed as an integral and continuous structure traversing a perimeter of the interior housing volume in substantial conformance to the predetermined geometry.

17. The device of claim 16, wherein the integral and continuous structure is formed from a ferrous material.

18. The device of claim 16, wherein the predetermined geometry is substantially circular.

19. The device of claim 1, wherein the segmented flexible wall structure is formed from a substantially rectangular and integral sheet of ferrous material having a first side and a second side, the integral sheet of ferrous material being shaped to traverse a perimeter of the interior housing volume in substantial conformance to the predetermined geometry such that the first side and the second side are separated by a gap.

20. The device of claim 19, wherein the integral and continuous structure is formed from a ferrous material.

21. The device of claim 19, wherein the predetermined geometry is substantially circular.

22. A circulator/isolator device comprising:

a housing including a substantially planar base portion integrally connected to a segmented flexible wall structure extending in a direction normal thereto, the substantially planar base portion and the segmented flexible wall structure forming an interior housing volume having a predetermined geometry, the segmented flexible wall structure including a plurality of port apertures disposed therein, the plurality of port apertures being separated from each other and disposed at predetermined locations in the segmented flexible wall structure;

a central stack disposed within the interior housing volume at a predetermined position on the base portion, the central stack including a substantially flat conductor having a plurality of port structures extending therefrom, each of the plurality of port structures being disposed at predetermined positions at a perimeter portion of the substantially flat conductor, the predetermined positions substantially conforming to the predetermined locations such that each of the plurality of port structures extend through the segmented flexible wall structure at a corresponding one of the plurality of port apertures;

a cover member disposed within the housing at one end thereof opposite the base portion such that an exterior major surface of the cover is accessible via an exterior of the device and an interior major surface of the cover is disposed adjacent the central stack; and a retaining member disposed around a perimeter of the segmented flexible wall structure at the one end, the retaining member being configured to apply a substantially uniform radial compressive force to the segmented flexible wall structure to retain the cover member there within, the cover member applying a registration force to the central stack assembly to maintain the central stack assembly at the predetermined position.

23. A method for making a circulator/isolator device, the method comprising:

forming a housing from a ferrous material, the housing including a segmented flexible wall structure configured to form an interior housing volume having a predetermined geometry, the segmented flexible wall structure including a plurality of port apertures disposed therein, the plurality of port apertures being separated from each other and disposed at predetermined locations in the segmented flexible wall structure;

providing a central stack assembly including a substantially flat conductor having a plurality of port structures extending therefrom, each of the plurality of port structures being disposed at predetermined positions at a perimeter portion of the substantially flat conductor, the predetermined positions substantially conforming to the predetermined locations, the central stack further including a plurality of magnetic circuit components sandwiching the substantially flat conductor therebetween;

installing the central stack assembly within the interior housing volume at a predetermined position, each of the plurality of port structures extending through the segmented flexible wall structure at a corresponding one of the plurality of port apertures;

providing at least one cover member substantially conforming to the predetermined geometry, the at least one cover member including an exterior major surface and an interior major surface;

enclosing the central stack within the housing by disposing the at least one cover member over the central stack and within the interior housing volume at one end thereof, the exterior major surface being accessible via an exterior of the device and the interior major surface being disposed adjacent the central stack; and positioning at least one retaining member around a perimeter of the segmented flexible wall structure at the one end, the at least one retaining ring being configured to apply a substantially uniform radial compressive force to the segmented flexible wall structure to retain the at least one cover member there within, the at least one cover member applying a registration force to the central stack assembly to maintain the central stack assembly at the predetermined position.

24. The method of claim 23, wherein the step of forming the housing further comprises:

forming a substantially circular and integral sheet of ferrous material having an origin and a vertical axis of symmetry disposed at a central portion thereof;

forming a substantially circular base portion having a radius extending a predetermined radial distance from the origin; and removing a plurality of portions extending from the radius to a perimeter portion of the integral sheet of ferrous material to form the plurality of port apertures and the segmented flexible wall structure, the segmented flexible wall structure being disposed substantially normal to the base portion and substantially parallel to the vertical axis of symmetry.

25. The method of claim 24, further comprising the step of forming a plurality of flexure gaps by removing material from the segmented flexible wall structure.

26. The method of claim 24, wherein the step of providing at least one cover member includes providing a single cover member, and wherein the step of enclosing includes the step of disposing the single cover member within the housing at the one end of the housing and in parallel to the base portion, the single cover member including a single exterior major surface accessible via an exterior of the device at the one end of the housing and an interior major surface disposed adjacent the central stack, an interior portion of the base portion also being adjacent the central stack assembly.

27. The method of claim 24, wherein the step of positioning the at least one retaining member includes the step of positioning a single retaining member substantially conforming to the predetermined geometry around a perimeter of the segmented flexible wall structure at the one end of the housing, the single retaining member being configured to apply the substantially uniform radial compressive force to the segmented flexible wall structure.

28. The method of claim 27, wherein the single retaining member is a tapered retaining ring having a conical cross-section, the conical cross-section including a relatively thicker surface that is substantially coplanar relative to the single exterior major surface and the one end.

29. The method of claim 24, wherein the step of providing at least one cover member includes:

providing a first cover member having a first exterior major surface and a first interior major surface, and providing a second cover member having a second exterior major surface and a second interior major surface, and wherein the step of positioning at least one retaining member includes:

providing a first retaining ring, and providing a second retaining ring.

30. The method of claim 29, further comprising the steps of disposing the first cover member within the housing at a first end of the housing;

positioning the first retaining ring disposed around a perimeter of the segmented flexible wall structure at the first end, the first retaining ring being configured to apply a substantially uniform radial compressive force to the segmented flexible wall structure to thereby retain the first cover member there within;

performing the step of installing the central stack assembly within the interior housing volume at the predetermined position such that the first interior major surface is disposed adjacent the central stack assembly and the first exterior major surface is accessible via an exterior of the device at the first end;

disposing the second cover member within the housing at a second end of the housing such that the second interior major surface is disposed adjacent the central stack and the second exterior major surface is accessible via an exterior of the device at the second end, the first cover member and the second cover member being substantially parallel to each other and substantially normal to the segmented flexible wall structure; and positioning the second retaining ring around the perimeter of the segmented flexible wall structure at the second end, the second retaining ring being configured to apply the substantially uniform radial compressive force to the segmented flexible wall structure.

31. The method of claim 30, wherein the first retaining ring is a tapered retaining ring having a conical cross-section, the conical cross-section includes a relatively thicker surface that is substantially coplanar relative to the first exterior major surface and the first end, and wherein the second retaining ring is a tapered retaining ring having a conical cross-section, the conical cross-section includes a relatively thicker surface that is substantially coplanar relative to the second exterior major surface and the second end.

32. The method of claim 29, wherein the step of forming the housing includes forming the segmented flexible wall structure as an integral and continuous structure traversing a perimeter of the interior housing volume in substantial conformance to the predetermined geometry.

33. The method of claim 29, wherein the step of forming the housing includes forming the segmented flexible wall structure from a substantially rectangular and integral sheet of ferrous material having a first side and a second side, the integral sheet of ferrous material being shaped to traverse a perimeter of the interior housing volume in substantial conformance to the predetermined geometry such that the first side and the second side are separated by a gap.

* * * * *